US010772776B2

(12) United States Patent
Allen

(10) Patent No.: US 10,772,776 B2
(45) Date of Patent: Sep. 15, 2020

(54) SUSPENSION SYSTEMS, POWERED WHEELCHAIRS WITH INDEPENDENT SUSPENSION SYSTEMS, AND METHOD FOR ASSEMBLING SUCH POWERED WHEELCHAIRS

(71) Applicant: Earthwatch, L.L.C., Prescott, AZ (US)

(72) Inventor: James M. Allen, Prescott, AZ (US)

(73) Assignee: EARTHWATCH, LLC, Prescott, AZ (US)

( * ) Notice: Subject to any disclaimer, the term of this patent is extended or adjusted under 35 U.S.C. 154(b) by 0 days.

(21) Appl. No.: 16/592,704

(22) Filed: Oct. 3, 2019

(65) Prior Publication Data

US 2020/0107979 A1 Apr. 9, 2020

Related U.S. Application Data

(60) Provisional application No. 62/740,880, filed on Oct. 3, 2018.

(51) Int. Cl.

| | |
|---|---|
| ***A61G 5/06*** | (2006.01) |
| ***A61G 5/10*** | (2006.01) |
| ***A61G 5/04*** | (2013.01) |

(52) U.S. Cl.

CPC ..... *A61G 5/1078* (2016.11); *A61G 5/041* (2013.01)

(58) Field of Classification Search

CPC ..... A61G 5/1078; A61G 5/06; A61G 5/1089; A61G 5/043; A61G 5/045; A61G 5/041; A61G 2203/14; A61G 5/10; A61G 5/128; A61G 2200/34; A61G 2203/30; A61G 2203/70; A61G 2210/10; A61G 5/042; A61G 5/047; A61G 5/1054; A61G (Continued)

(56) References Cited

U.S. PATENT DOCUMENTS 5,518,081 A * 5/1996 Thibodeau ..... B60N 2/38 180/210
5,575,348 A * 11/1996 Goertzen ..... A61G 5/045 180/65.6

(Continued)

FOREIGN PATENT DOCUMENTS

| | | |
|---|---|---|
| DE | 102016116371 | 3/2018 |
| WO | 2018161443 | 9/2018 |

OTHER PUBLICATIONS

International Search Report and Written Opinion for International Application No. PCT/US2019/054590, dated Dec. 20, 2019.

*Primary Examiner* — Paul N Dickson
*Assistant Examiner* — Hilary L Johns
(74) *Attorney, Agent, or Firm* — Bryan Cave Leighton Paisner LLP

(57) ABSTRACT

An embodiment can include a suspension system for a powered wheelchair, the suspension system comprising an arm and an air suspension subsystem. The air suspension subsystem in this embodiment can comprise a coil spring and an air bag surrounded by the coil spring. The arm in this embodiment can be configured to (a) couple a drive axle to a frame of the powered wheelchair and (b) move the drive axle relative to the frame. In this embodiment, a first end of the drive axle can be coupled to a wheel of the powered wheelchair, while the frame is closer to a second end of the drive axle than the first end, and the first end of the drive axle is opposite the second end of the drive axle. A first end of the air suspension subsystem in this embodiment can be coupled to the frame when a second end of the air suspension subsystem is coupled to the arm and the second end of the air suspension subsystem is opposite the first end of the air suspension subsystem. Other embodiments are disclosed.

20 Claims, 4 Drawing Sheets

(58) Field of Classification Search
CPC ... 5/1062; A61G 5/107; A61G 5/1075; A61G 5/1081; A61G 5/1091; A61G 7/05769; B60G 2300/24; B60G 17/052; B60G 21/023; B60G 21/026; B60G 21/10; B60G 2200/13; B60G 2202/21; B60G 2202/312; B60G 2204/30; B60G 2300/07; B60G 2300/402; B60G 3/12; B60G 3/145; B60G 3/207
USPC ..... 180/65.1
See application file for complete search history.

(56) References Cited

U.S. PATENT DOCUMENTS 5,772,237 A * 6/1998 Finch ..... A61G 5/06 180/65.1
5,853,059 A 12/1998 Goertzen et al.
8,066,265 B2 11/2011 Leonard
8,851,214 B2 10/2014 Mirzaie
9,039,018 B1 * 5/2015 Lin ..... B60G 3/12 280/124.129
9,072,640 B2 7/2015 Wu
9,700,470 B2 * 7/2017 Bekoscke ..... A61G 5/1078
10,052,247 B2 8/2018 Vereen, III et al.
2001/0011613 A1 * 8/2001 Schaffner ..... A61G 5/043 180/65.1
2003/0089537 A1 * 5/2003 Sinclair ..... A61G 5/047 180/65.1
2006/0076748 A1 * 4/2006 Pauls ..... A61G 5/043 280/124.11
2006/0192362 A1 * 8/2006 Makhsous ..... A61G 5/1043 280/250.1
2018/0050562 A1 * 2/2018 Winshtein ..... A61G 5/06

* cited by examiner

SUSPENSION SYSTEMS, POWERED WHEELCHAIRS WITH INDEPENDENT SUSPENSION SYSTEMS, AND METHOD FOR ASSEMBLING SUCH POWERED WHEELCHAIRS

CROSS-REFERENCE TO RELATED APPLICATIONS

This application claims priority to U.S. Provisional Patent Application No. 62/740,880, filed Oct. 3, 2018. U.S. Provisional Patent Application No. 62/740,880 is incorporated herein by reference in its entirety.

TECHNICAL FIELD

This disclosure relates generally to powered wheelchairs comprising independent suspension systems.

BACKGROUND

Traditional wheelchairs are designed for smooth urban roads, not for bumpy or unsurfaced roads, and are thus of limited use for active users. All-terrain powered wheelchairs made for off-road use exist, but they are generally too large for indoor use and/or lack an adjustable suspension needed to accommodate different road or off-road conditions. Therefore, improved powered wheelchairs that are small enough to pass through household doors and designed for a smooth ride even when the user is navigating thresholds or riding on unsurfaced roads are desired.

BRIEF DESCRIPTION OF THE DRAWINGS

To facilitate further description of the embodiments, the following drawings are provided in which.

Figure 1:
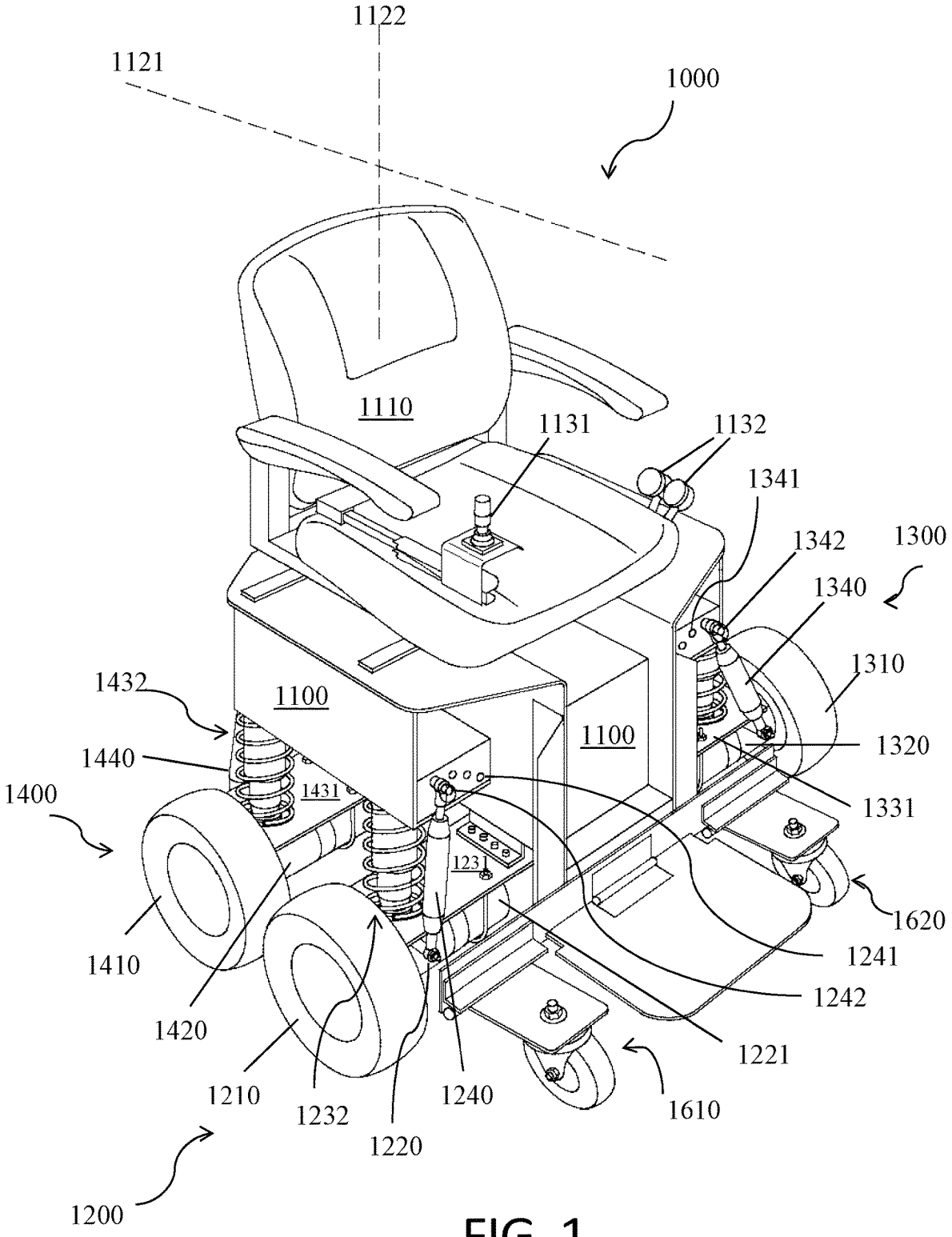
FIG. 1 illustrates a front perspective view of a powered wheelchair, according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

As defined herein, "real-time" can, in some embodiments, be defined with respect to operations carried out as soon as practically possible upon occurrence of a triggering event. A triggering event can include receipt of data necessary to execute a task or to otherwise process information. Because of delays inherent in transmission and/or in computing speeds, the term "real-time" encompasses operations that occur in "near" real-time or somewhat delayed from a triggering event. In a number of embodiments, "real-time" can mean real-time less a time delay for processing (e.g., determining) and/or transmitting data. The particular time delay can vary depending on the type and/or amount of the data, the processing speeds of the hardware, the transmission capability of the communication hardware, the transmission distance, etc. However, in many embodiments, the time delay can be less than approximately one second, five seconds, ten seconds, thirty seconds, one minute, five minutes, ten minutes, or fifteen minutes.

As defined herein, "parallel" should be broadly understood and refer to two or more elements being parallel or approximately parallel to each other. As defined herein, "perpendicular," "perpendicularly," and the like should be broadly understood and refer to two or more elements being perpendicular or approximately perpendicular to each other. As defined herein, "central" should be broadly understood and refer to being at, or of, the center of an element or being approximately at, or of, the center of the element. As defined herein, "along" should be broadly understood and refer to extending in a constant direction on, or approximately on, an element. As defined herein, "symmetric," "symmetrically," and the like should be broadly understood and refer to two or more elements being similar or approximately similar to each other or being arranged in a similar or approximately similar manner.

DESCRIPTION OF EXAMPLES OF EMBODIMENTS

Various embodiments include a suspension system for a powered wheelchair, the suspension system comprising an arm and an air suspension subsystem. In a number of embodiments, the arm can be configured to: (a) couple a drive axle to a frame of the powered wheelchair and (b) move the drive axle relative to the frame. In some embodiments, a first end of the drive axle can be coupled to a wheel of the powered wheelchair, while the frame is closer to a second end of the drive axle than the first end, and the first end of the drive axle is opposite the second end of the drive axle.

In a number of embodiments, the drive axle also can comprise a motor powered by an energy source, such as one or more batteries of the powered wheelchair. An example of such a motor can be a 24-volt brushed direct-current (DC) gear motor, e.g., an MMP D33-455D gear motor by Midwest Motion Products, LLC of Howard Lake, Minn., United States of America, with a rated peak torque of 1,060 inch-pounds and a continuous rated torque rate of 74 inch-pounds, or any suitable motor that is different in size and/or torque ratings, depending on the desired applications and weight capacity of the powered wheelchairs. An example of the batteries used in an embodiment can include 2 batteries wired in series, e.g., two 12 volt (V), 80 amp-hour (AH) Duracell® Deep Cycle batteries by Duracell U.S. Operations, Inc. of Wilmington, Del., United States of America. Further, in several embodiments, the wheel coupled to the drive axle can be of any suitable wheels with tires that are configured to get sufficient traction on rough outdoor surfaces while not streaking or scuffing indoor floors, such as PR1MO® Durotrap 10"×3" air filled tires by Xiamen Lenco Co., Ltd. of Xiamen, Fujian, China.

In many embodiments, the air suspension subsystem can comprise a coil spring and an air bag surrounded by the coil spring. The coil spring in an embodiment can be any suitable coil spring that has suitable measurements and/or strengths (rates), such as ¼"-⅓" (inches) in metal thickness, 6"-8" in spring height, 3" in inside coil diameter, and/or being rated 60 lbs. (pounds), 80 lbs., or 100 lbs., etc. An example of the coil spring is a PAC RACING® coil-over springs by Peterson American Corporation of Southfield, Mich., United States of America. The air bag for the air suspension system in an embodiment can be any suitable air bag any that has suitable measurements and/or strengths (rates), such as 2½" in exterior diameter, 6"-8" in exterior height, and/or being rated up to 100 lbs., etc. An example of the air bag is an Air Lift® air bag by Air Lift Company of Lansing, Mich., United States of American.

In a number of embodiments, a first end of the air suspension subsystem can be coupled to the frame of the wheelchair while a second end of the air suspension subsystem can be coupled to the arm of the suspension system and the second end of the air suspension subsystem is opposite the first end of the air suspension subsystem. In some embodiments, the first and second ends of the air suspension subsystem are at distal ends of a helical axis of the coil spring, while the helical axis is non-parallel to a central longitudinal axis of the powered wheel chair. For example, the helical axis can be parallel to a vertical axis of the powered wheelchair, and the vertical axis can be perpendicular to a central longitudinal axis of the powered wheelchair. The central longitudinal axis generally extends parallel to or along a forward- and/or backward-moving direction of the power wheelchair. In some embodiments, the air bag can be centered within the coil spring along the helical axis of the coil spring so that the air suspension system can be stable when the first/upper end of the air suspension system is coupled to the frame, and when the second/lower end of the air suspension system is coupled to the arm.

Additionally, in a number of embodiments, the air pressure of the air bag can be adjustable by the user while the user is sitting in and operating the powered wheelchair. This real-time, user-controlled configuration of the powered wheelchair can be beneficial because the user can change the amount of load buffering of the suspension systems in real-time according to different road conditions, such as when the user is riding in the powered wheelchair out of the house, etc. In some embodiments, the powered wheelchair can further comprise: (a) an air compressor, such as a 12-volt Air Lift® air compressor by Air Lift Company of Lansing Mich., United States of American, coupled to the air bag of the air suspension subsystem; (b) an air gauge configured to monitor the air pressure in the air bag, and (c) a controller, e.g., a switch, configured to receive the user's command to activate the air compressor to pump or release the air into/from the air bag. Generally speaking, the user can lower the air pressure of the air bag for a softer ride, such as when the user is riding in a rough terrain. On smooth surfaces, the user can raise the air pressure of the air bag to stiffen the air suspension subsystem for better handling of the powered wheelchair.

In some embodiments, the suspension system also can comprise a dampener configured to regulate the bounce of the arm of the suspension subsystem. The first end of the dampener can be coupled to the frame of the powered wheelchair, while a second end of the dampener can be coupled to the arm at a distal end of the arm away from the rod, and the second end of the dampener is opposite the first end of the dampener. Examples of such a dampener can include air shocks, hydraulic damping cylinders, and air damping cylinders, etc., such as ACE™ DVC-2 adjustable dampeners by Ace Controls, Inc. of Farmington, Mich., United States of America. In some embodiments, the dampener further can comprise one or more suitable adjustment mechanisms, such as 2 adjustment knobs each located at the first end or the second end of the dampener, respectively, to change the amount of allowed rebound of the arm.

Furthermore, in a number of embodiments, an angle between the dampener and the arm of the suspension system can be adjustable based on a first adjustable location where the first end of the dampener is coupled to the frame of the powered wheelchair and/or a second adjustable location where the second end of the dampener is coupled to the arm. In general, when the angle is close to 90 degrees (i.e., the dampener is nearly vertical or perpendicular to the arm), the dampener can act more like a car shock, and when angled away from the vertical or perpendicular position, the dampener can act more like a suspension with more flex for extreme surfaces. Such changes of angle can be achieved by a mechanism or manually. For example, the suspension system of an embodiment additionally can include a motor configured to change the first adjustable location and/or the second adjustable location along a track under the user's control via a switch, a button, a lever, a knob, etc. In an embodiment, the suspension system further can include a slide, such as MS200-3-AL-S3 slide by Generic Slides of Glenshaw, Pa., United States of America, that is configured to be controlled manually, electrically, hydraulically, and/or pneumatically to guide the first/upper end or the second/lower end of the dampener along the track to the first adjustable location or the second adjustable location. The locations for the first adjustable location or the second adjustable location can be at a predetermined number of fixed spots or on a continuous path. Alternatively, a user can change the angel between the dampener and the arm of the suspension system by: (a) attaching the first end of the dampener to a first receiving hole, groove, or the like on the frame with a first removable pin, and/or (b) attaching the second end of the dampener to a second receiving hole, groove, or the like, on the arm with a second removable pin.

In some embodiments, the suspension system also can comprise an anti-sway structure configured to stabilize the air suspension subsystem by restricting the sway of the air suspension subsystem. An exemplary anti-sway structure is a metal sleeve coupled to, and extending from, the arm and enclosing, at least partially, a third or halfway up to the top of, the air suspension subsystem from the second end of the air suspension subsystem.

Various embodiments further include a powered wheelchair comprising: (a) a seat, (b) a frame, (c) a first wheel assembly, and (d) a second wheel assembly. The seat of the powered wheelchair in an embodiment can further include a back, a cushion, armrests, and/or a seatbelt. In many embodiments, the frame is configured to support the seat. In some embodiments, the first wheel assembly can comprise: (a) a first wheel, (b) a first drive axle coupled to the first wheel, and (c) a first suspension system configured to movably couple the first drive axle, at an end of the first drive axle away from the first wheel, to the frame. In several embodiments, the second wheel assembly can comprise: (a) a second wheel, (b) a second drive axle coupled to the second wheel, and (c) a second suspension system configured to movably couple the second drive axle, at an end of the second drive axle away from the second wheel, to the frame.

In some embodiments, the first and/or second suspension systems can be similar or identical to any of the suspension systems in the aforementioned embodiments. In some embodiments, the first/second drive axles and/or the first/second wheels also can be similar or identical to any of the drive axles and/or wheels in the aforementioned embodiments. In a number of embodiments, the powered wheelchair further can comprise one or more batteries and one or more onboard chargers for the one or more batteries. The one of more batteries in an embodiment can be configured to power the powered wheelchair to run a relatively long distance before recharging, such as a mile, 2 miles, 8 miles, 10 miles, and so forth. In several embodiments, the powered wheelchair also can comprise a third and/or a fourth wheel assemblies.

In a number of embodiments, the first wheel assembly and the second wheel assembly can be positioned symmetrically about a central longitudinal axis of the powered wheelchair. In an embodiment with four wheel assemblies, the first wheel assembly and the second wheel assembly (i.e., the two front wheel assemblies) can be positioned symmetrically about the central longitudinal axis of the powered wheelchair while the third wheel assembly and the fourth wheel assembly (i.e., the two rear wheel assemblies) can be positioned symmetrically about the central longitudinal axis of the powered wheelchair. In many embodiments, the first drive axle and the second drive axle, and/or the third and fourth drive axles, etc., if any, each can comprise a respective motor to rotate the respective drive axle to drive the respective wheel. With their respective wheel, drive axle, and suspension system, the first wheel assembly and the second wheel assembly, as well as any additional wheel assemblies, in some embodiments can be operated independently from each other. A similar or other exemplary embodiment of the powered wheelchair thus can have a tank like steering that allows for a zero-turn radius for more maneuverability.

In some embodiments, the frame of the powered wheelchair also can comprise a rod extending parallel to, or along, a central longitudinal axis of the powered wheelchair. In a number of embodiments, the frame of the powered wheelchair further can comprise a first rod and a second rod, each extending parallel to a central longitudinal axis of the powered wheelchair. In several embodiments with the first and second rods, the first and second rods can be placed in any suitable manner, such as being side by side or one above the other, etc. An exemplary rod of the rod, the first rod, or the second rod, etc. can be a ¾-inch smooth rolled shaft, located beneath the seat and mounted to the frame with one or more shaft support supporters, such as NB™ Linear Systems shaft support supporter by Nippon Bearing Co., Ltd. of Niigata, Japan.

In some embodiments where the frame comprises a rod, at least one of the first suspension system or the second suspension system can be coupled to the rod and configured to move the respective drive axle relative to the frame, by the at least one of the first suspension system or the second suspension system swiveling around the respective rod. In some embodiments, the at least one of the first suspension system or the second suspension system can be coupled to the rod by a bearing. An example of such bearing is a pillow block bearing, e.g., a closed series Frelon® lined pillow block by Pacific Bearing Corp. of Rockford Ill., United States of America with one or more 4200 Polytetrafluoroethylene (PTFE) sleeve bearing inserts.

In some embodiments, at least one of the first suspension system or the second suspension system further can comprise a respective arm and a respective air suspension subsystem. In some embodiments, a respective first end of the respective air suspension subsystem can be coupled to the frame, while a respective second end of the respective air suspension subsystem can be coupled to the respective arm, and where the respective second end of the respective air suspension subsystem is opposite the respective first end of the respective air suspension subsystem. In several embodiments, the at least one of the first suspension system or the second suspension system can be coupled to the rod, at the respective arm; and in similar or other embodiments, the respective arm can be configured to move a respective drive axle relative to the frame by the respective arm swiveling around the respective rod (the respective drive axle is the drive axle that is movably coupled to the frame by the at least one of the first suspension system or the second suspension system). In a number of embodiments, the respective first and second ends of the respective air suspension subsystem are at respective distal ends of a respective helical axis of the respective coil spring, while the respective helical axis can be non-parallel to the central longitudinal axis. For example, the respective helical axis can be parallel to a vertical axis of the powered wheelchair, and the vertical axis can be perpendicular to the central longitudinal axis.

In a number of embodiments, the respective air suspension subsystem can comprise a respective coil spring and a respective air bag surrounded by the respective coil spring. The respective coil spring in an embodiment can be similar or identical to the coil springs in any of the aforementioned embodiments. The respective air bag in an embodiment can be similar or identical to the air bags in any of the aforementioned embodiments. In an embodiment with more than one suspension system, each comprising an air suspension subsystem, the respective coil spring and/or the respective air bag used for each of the more than one suspension system can be similar or not similar.

In some embodiments, at least one of the first suspension system or the second suspension system also can comprise a respective dampener. The respective dampener in an embodiment can be similar or identical to any of the dampeners in the embodiments above. In several embodiments, a first end of the respective dampener can be coupled to the frame of the powered wheelchair, while a second end of the respective dampener can be coupled to the at least one of the first suspension system or the second suspension system, and where the second end of the respective dampener is opposite the first end of the respective dampener. In a number of embodiments, a respective angle between the respective dampener and a vertical axis of the powered wheelchair can be adjustable based on a first adjustable location where the first end of the respective dampener is coupled to the frame of the powered wheelchair and/or based on a second adjustable location where the second end of the respective dampener is coupled to the arm.

In some embodiments, the powered wheelchair additionally can comprise one or more of any suitable control mechanisms, such as a joystick, a control panel, a touch screen, a button, a switch, a lever, a knob, etc. that can be configured to control one or more of the speed, acceleration, or direction of the powered wheelchair, the respective air pressure of the respective air pressure subsystem, or the first/second location of the respective dampener, etc. An example of the controller can be a RoboteQ® MDC 2460 2-channel controller by Roboteq, Inc. of Scottsdale, Ariz., United States of America, that can be used to separately control 2 motors on the left side of a 4-wheel-drive powered wheelchair and the other 2 motors on the right side. In several embodiments, the powered wheelchair also can comprise a controller configured for a user to control a respective air pressure of the respective air bag, such as 10 lbs., 35 lbs., 50 lbs., 90 lbs., etc., while the user is sitting in the seat of the powered wheelchair and/or operating the powered wheelchair. In some embodiments, the powered wheelchair further can comprise an air gauge configured to monitor the air pressure in the respective air bag. In some embodiments, the user can adjust the air pressure in the respective air bag based on a reading from the air gauge, displayed on a scale or a screen. In several embodiments, the power wheelchair can comprise a computer configured to automatically adjust the air pressure of the respective air bag based on the settings and the reading from the air gauge that can be changed by the user, via a user interface, such as a switch, a touch screen, or a remote App on a mobile device. In an embodiment with one or more air bags, the powered wheelchair can comprise a single air gauge configured to monitor only one of the air bags. In another embodiment with more than one air bags, the powered wheelchair can comprise more than one air gauges each configured to monitor one of the air bags.

In a number of embodiments, the powered wheelchair further can comprise front casters. In an exemplary embodiment with four independent drive wheel assemblies (two front wheel assemblies and two rear wheel assemblies), the front casters each can comprise a 6-inch wheel and be configured to allow access to up to 1-3 inches of threshold or curbing while still keeping the wheel assemblies in contact with the ground until the front casters raise the front of the wheelchair enough to give the front wheel assemblies the clearance they need to climb over the obstacle while the rear wheel assemblies provide the extra traction. In some embodiments, each caster of the front casters can be coupled to the frame of the powered wheelchair by a respective torsion spring hinge configured to allow the each caster to move upward vertically when the each caster hits an obstacle. An exemplary torsion spring can be rated up to 75 lbs.

In some embodiments, the powered wheelchair also can comprise rear casters configured to prevent the powered wheelchair from tipping backwards, caused by the thrust of the motors and/or climbing a steep grade, such as by keep all the wheel assemblies on the ground. The powered wheelchair in an embodiment with rear casters can be configured to climb a 20-degree slope, when comparable wheelchairs may be limited to 7-degree slopes or lower slopes.

Various embodiments additionally include a method for assembling a powered wheelchair. In many embodiments, the powered wheelchair assembled by the method can be similar or identical to, and comprise one or more of the elements of, any of the powered wheelchairs in the embodiments above. In a number of embodiments, the method can comprise: (a) positioning a first wheel assembly and a second wheel assembly symmetrically about a central longitudinal axis of the powered wheelchair; (b) movably coupling a first drive axle of a first wheel assembly to a frame of the powered wheelchair by a first suspension system of the first wheel assembly; and (c) movably coupling a second drive axle of a second wheel assembly to the frame of the powered wheelchair by a second suspension system of the second wheel assembly. In some embodiments, the method also can comprise: coupling an end of the first drive axle, away from the frame, to a first wheel of the first wheel assembly; and/or coupling an end of the second drive axle, away from the frame, to the second wheel.

In some embodiments, at least one of the first suspension system or the second suspension system comprises a respective arm and a respective air suspension subsystem. In a number of embodiments, the method also can comprise coupling the respective arm to a rod of the frame so that the respective arm can be configured to move a respective drive axle of the first drive axle or the second drive axle relative to the frame by the respective arm swiveling around the rod. For instance, in an embodiment where the first suspension system comprises a first arm and a first air suspension subsystem, the method additionally can comprise coupling the first arm to the rod of the frame so that the first arm can move the first drive axle relative to the frame by the first arm swiveling around the rod.

In a number of embodiments, the method further can comprise: coupling a respective first end of a respective air suspension subsystem of at least one of the first suspension system or the second suspension system to the frame of the powered wheelchair; and/or coupling a respective second end of the respective air suspension subsystem to a respective arm of the at least one of the first suspension system or the second suspension system. In some embodiments, the respective second end of the respective air suspension subsystem is opposite the respective first end of the respective air suspension subsystem; the respective first and second ends of the respective air suspension subsystem are at respective distal ends of a respective helical axis of the respective coil spring; and the respective helical axis can be non-parallel to the central longitudinal axis. For example, the respective helical axis can be parallel to a vertical axis of the powered wheelchair; and the vertical axis can be perpendicular to the central longitudinal axis.

In a number of embodiments, the method also can comprise coupling a second end of a respective dampener to at least one of the first suspension system or the second suspension system, and coupling a first end of the respective dampener to the frame of the powered wheelchair, where the second end of the respective dampener is opposite the first end of the respective dampener. In some embodiments, the method further can comprise coupling the first end of the respective dampener to an adjustable location of the frame of the powered wheelchair so that a respective angle between the respective dampener and a vertical axis of the powered wheelchair can be adjustable.

In some embodiments, the method also can comprise: (a) coupling each caster of the front casters of the powered wheelchair to the frame of the powered wheelchair by a respective torsion spring hinge that is configured to allow each caster to move upward vertically when each caster hits an obstacle; and/or (b) coupling rear casters to the frame of the powered wheelchair, the rear casters being configured to prevent the powered wheelchair from tipping backwards.

Figure 2:
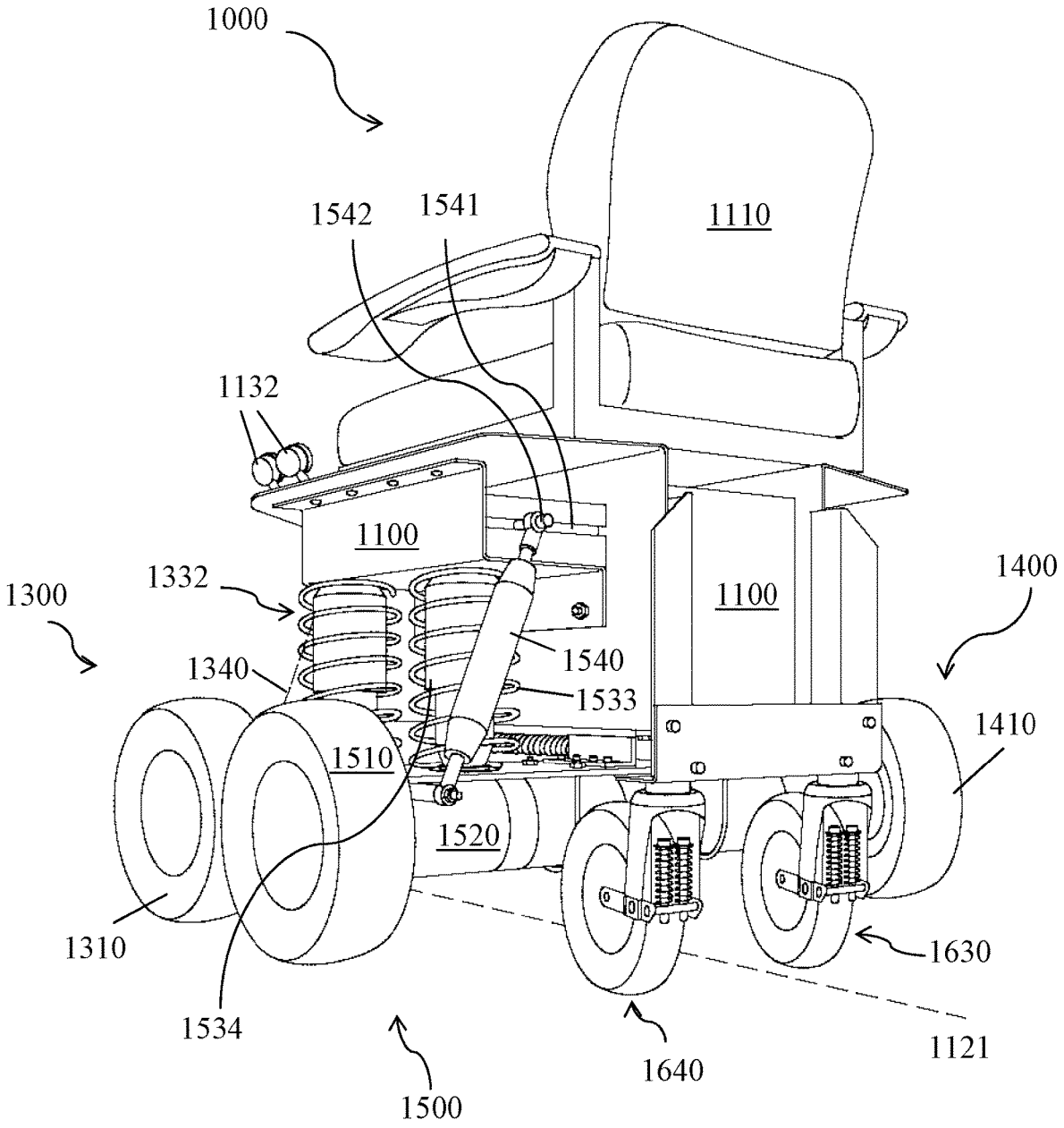
FIG. 2 shows a rear perspective view of the powered wheelchair, according to the embodiment in FIG. 1.
Figure 3:
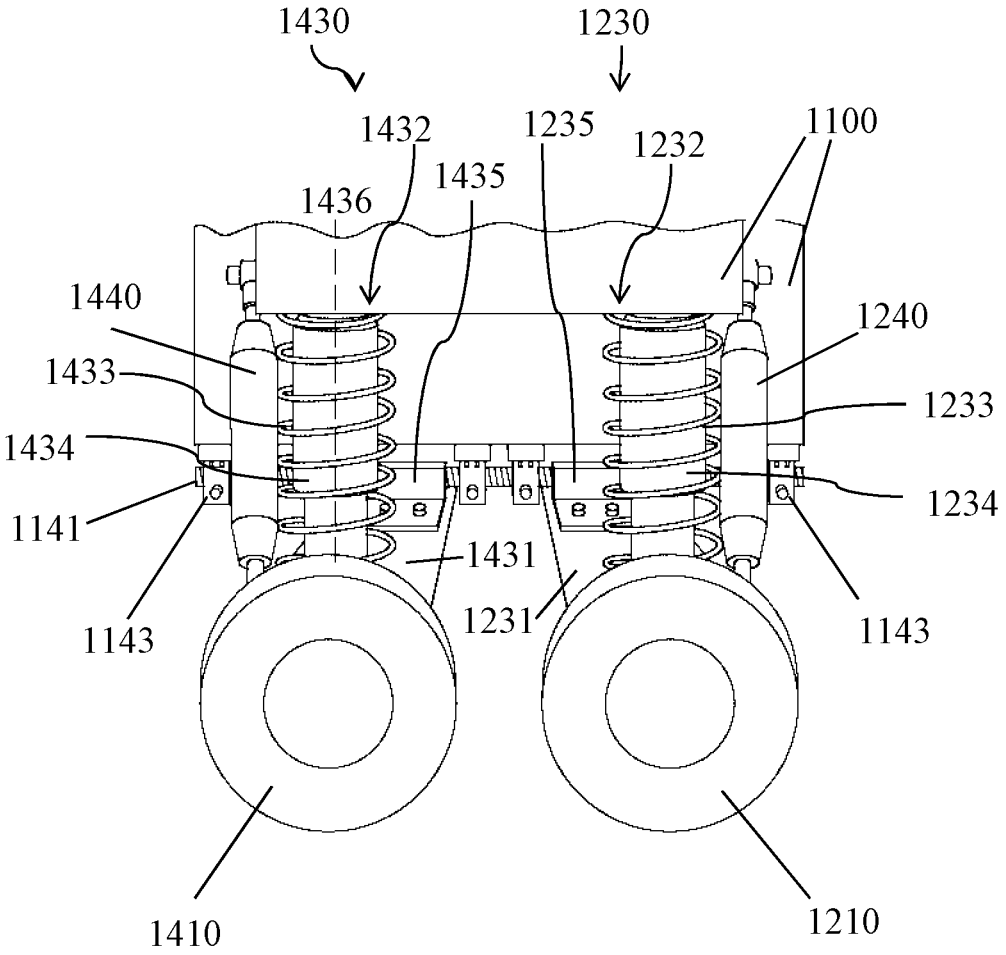
FIG. 3 shows a partial side view of the powered wheelchair (with the front and rear casters removed), according to the embodiment in FIG. 1.
Figure 5:
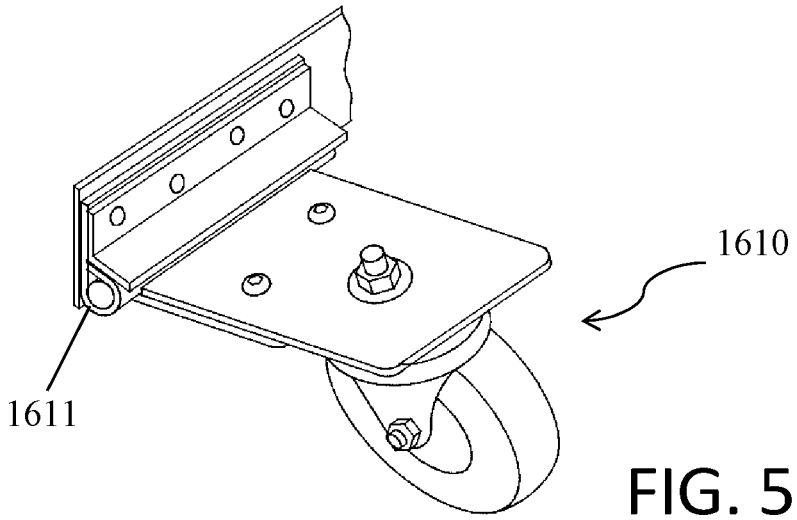
FIG. 5 shows a partial perspective view of the powered wheelchair, according to the embodiment in FIG. 1.
Figure 4:
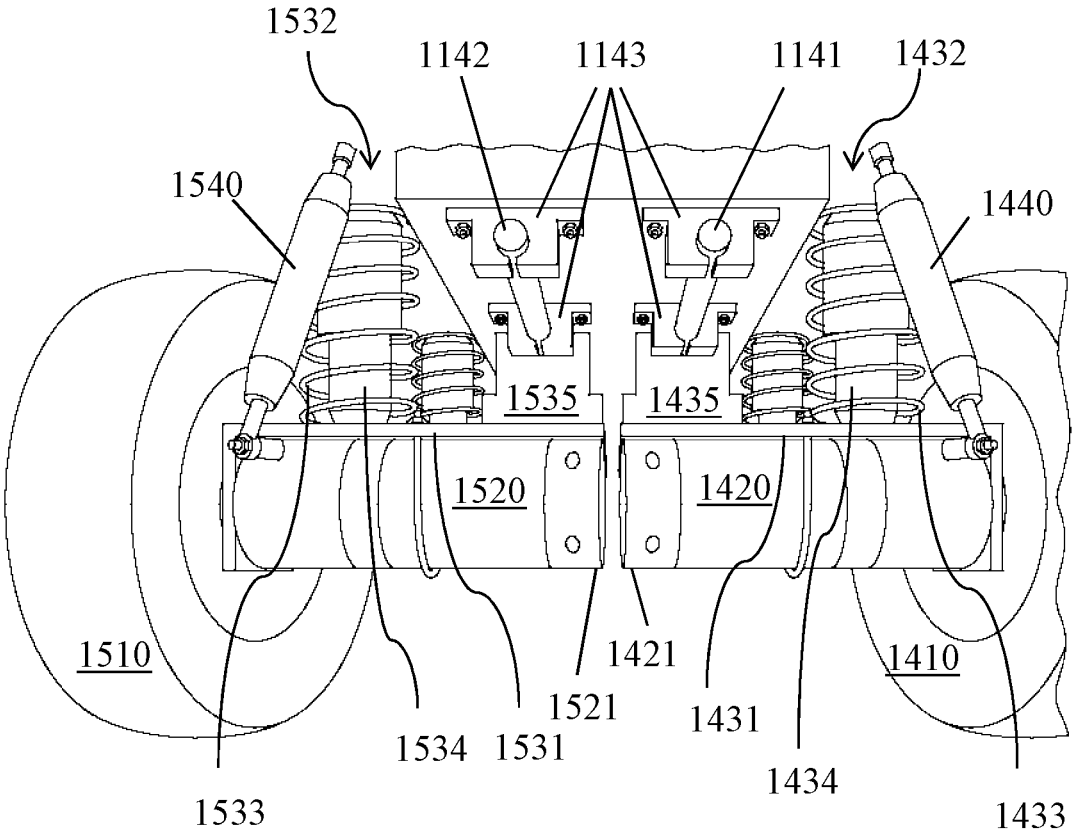
FIG. 4 shows a partial lower rear view of the powered wheelchair (with the rear casters removed), according to the embodiment in FIG. 1.

Turning to the drawings, FIGS. 1-5 illustrate various views of a powered wheelchair (1000), according to an embodiment. In this and other embodiments, powered wheelchair (1000) can comprise: (a) a frame (1100); (b) a seat (1110); (c) two or more wheel assemblies (1200, 1300, 1400, and 1500); (d) a central longitudinal axis (1121); (e) a vertical axis (1122); (f) a controller (1131); (g) one or more air gauges (1132); (h) front casters (1610 and 1620); and (i) rear casters (1630 and 1640). In some embodiments, powered wheelchair (1000) further can comprise: one or more batteries with a charger (not shown, placed inside frame 1100) configured to power the electric components of powered wheelchair 1000; and an air compressor (not shown, placed inside frame 1100), etc.

In many embodiments, frame 1100 is configured to support seat 1110. In several embodiments, seat 100 can include one or more of a cushion, armrests, a seatbelt, a footrest, and/or a back, etc. In a number of embodiments, wheel assemblies 1200, 1300, 1400, and 1500 each can comprise: (a) a respective wheel (1210, 1310, 1410, or 1510), (b) a respective drive axle (1220, 1320, 1420, or 1520) with a respective motor, and (c) a respective suspension system (1230, 1330, 1430, or 1530). In some embodiments, wheel assemblies (1200, 1300, 1400, and 1500) each can be configured to absorb a respective lateral shock on a respective wheel (1210, 1310, 1410, or 1510) and to work independently.

In some embodiments, suspension systems (1230, 1330, 1430, and 1530) each can comprise a respective arm (1231, 1331, 1431, or 1531) and a respective air suspension subsystem (1232, 1332, 1432, or 1532). The respective arm (1231, 1331, 1431, or 1531) can be configured to movably couple a respective end (1221, 1321, 1421, or 1521) of the respective drive axle (1220, 1320, 1420, or 1520) to a respective rod (1141 or 1142) of frame 1100. For instance, arm 1231 of suspension system 1230 and arm 1431 of suspension system 1430 each can be configured to movably couple drive axles 1220 or 1420 respectively to rod 1141 while arm 1331 of suspension system 1330 and arm 1531 of suspension system 1530 each can be configured to movably couple drive axles 1320 or 1520 respectively to rod 1142. In a number of embodiments, rods 1141 and 1142 of frame 1100 each can extend parallel to central longitudinal axis 1121, which extends parallel to a forward- or backward-moving direction of powered wheelchair 1000. In some embodiments, first wheel assembly 1200 and second wheel assembly 1300 are positioned symmetrically to each other about the central longitudinal axis 1700, and so are third wheel assembly 1400 and fourth wheel assembly 1500 to each other.

In some embodiments, rods 1141 and 1142 each can be coupled to the frame 1100 by one or more shaft support supporters 1143. In several embodiments, arm 1231 is coupled to rod 1141 via bearing 1235 (e.g., a pillow block bearing), arm 1331 is coupled to rod 1142 via bearing 1335, and arms 1431 and/or 1531 can be coupled to the respective rod (1141 or 1142) using a similar or identical bearing 1435 or 1535. In such or other embodiments, arms 1231 and 1431, and the respective drive axle (1220 or 1420) and the respective wheel (1210 or 1410), can swivel around rod 1141 while arms 1331 and 1531, along with the respective drive axle (1220 or 1420) and the respective wheel (1210 or 1410), can swivel around rod 1142.

In certain embodiments, rods 1141 and 1142 can be located under seat 1110, parallel to and near central longitudinal axis 1121, while suspension systems 1230, 1330, 1430, and 1530, as well as their respective drive axles (1220, 1320, 1420, or 1520), can be located substantially under seat 1110, so that powered wheelchair 1000 can be suitable for indoor use when the powered wheelchair 1000 is small enough to pass through household doors.

In a number of embodiments, the respective air suspension subsystem (1231, 1332, 1432, or 1532) can comprise: a respective coil spring (1233, 1333, 1433, or 1533) and a respective air bag (1234, 1334, 1434, or 1534) surrounded by the respective coil spring (1233, 1333, 1433, or 1533). In some embodiments, a respective first/upper end of the respective air suspension subsystem (1232, 1332, 1432, or 1532) is coupled to frame 1100, and a respective second/lower end of the respective air suspension subsystem (1232, 1332, 1432, or 1532) is coupled to the respective arm (1231, 1331, 1431, or 1532), the respective second/lower end of the respective air suspension subsystem (1232, 1332, 1432, or 1532) being opposite the respective first/upper end of the respective air suspension subsystem (1232, 1332, 1432, or 1532). In some embodiments, the respective first/upper and second/lower ends of the respective air suspension subsystem (1232, 1332, 1432, or 1532) are at respective distal ends of a respective helical axis (e.g., 1436 in FIG. 3) of the respective coil spring (1233, 1333, 1433, or 1533), where the respective helical axis (e.g., 1437 in FIG. 3) can be non-parallel to central longitudinal axis 1121. For example, respective helical axis (e.g., 1437 in FIG. 3) can be parallel to vertical axis 1122 of powered wheelchair 1100 while vertical axis 1122 can be perpendicular to central longitudinal axis 1121.

In a number of embodiments, suspension systems (1230, 1330, 1430, and 1530) each further can comprise a respective dampener (1240, 1340, 1440, or 1540). As shown in the embodiment in FIGS. 1-5, the first/upper end of the respective dampener (1240, 1340, 1440, or 1540) can be coupled to frame 1100 while the second/lower end of the respective dampener (1240, 1340, 1440, or 1540) can be coupled to the respective suspension system (1230, 1330, 1430, or 1530), the second/lower end of the respective dampener (1240, 1340, 1440, or 1540) being opposite the first/upper end of the respective dampener (1240, 1340, 1440, or 1540). In several embodiments, a respective angle between the respective dampener (1240, 1340, 1440, or 1540) and vertical axis 1122 of powered wheelchair 1000 is adjustable based on an adjustable location where the first/upper end of the respective dampener (1240, 1340, 1440, or 1540) is coupled to frame 1100.

In some embodiments, the first/upper end of the respective dampener (1240, 1340, 1440, or 1540) can comprise a respective attachment member, such as a respective removable pin (1242 or 1342) or a respective fastener (1442 (not shown) or 1542), while frame 1100 comprises multiple corresponding attachment members, such as respective adjustment holes (1241 or 1341) or a respective slide adjuster (1441 (not shown) or 1541). In several embodiments, the respective adjustment holes (1241 or 1341) each can be configured to receive the respective removable pin (1242 or 1342) so that the respective angle between the respective dampener (1240 or 1340) and vertical axis 1122 can be adjusted by the user securing the respective removable pin (1242 or 1342) of the first/upper end of the respective dampener (1240 or 1340) to one of the respective adjustment holes (1241 or 1341). In a number of embodiments, the respective slide adjuster (1441 (not shown) or 1541) can comprise a respective motor (not shown, placed inside frame 1100) and a respective track, and the respective motor can be coupled to the respective fastener (1442 (not shown) or 1542) and configured to pull the first/upper end of the respective dampener (1440 or 1540) to a location along the respective track according to the user's command received from controller (1131) or an additional control mechanism such as a switch, a knob, or a button, etc.

In a number of embodiments, controller 1131 of powered wheelchair 1000 can be configured for a user to control the air pressure of air bag 1234, 1334, 1434, and 1534, by activating the air compressor to increase or withdraw air into or from one or more of air bags 1234, 1334, 1434, and 1534, while the user is sitting in seat 1110 of powered wheelchair 1000. In some embodiments, air gauges 1132 can be configured to show the air pressure of one or more of air bag 1234, 1334, 1434, and 1534. In several embodiments, the user can determine when to use controller 1131 to control the air pressure of air bag 1234, 1334, 1434, and 1534 based on the readings of the air gauges. In some embodiments, powered wheelchair 1000 also can comprise a computer to control the air pressure of air bag 1234, 1334, 1434, and 1534 based on the readings of the air gauges.

In a number of embodiments, powered wheelchair 1000 further can comprise front casters 1610 and 1620. In some embodiments, front caster 1610 can be coupled to frame 1100 by torsion spring hinge 1611, and front caster 1620 can be coupled to frame 1100 by torsion spring hinge 1621. In several embodiments, torsion spring hinges 1611 and 1621 each can be configured to allow front casters 1610 or 1620 respectively to move upward vertically when front casters 1610 or 1620 hits an obstacle. In a number of embodiments, powered wheelchair 1000 additionally can comprise rear casters 1630 and 1640 configured to prevent powered wheelchair 1000 from tipping backwards. In some embodiments, rear casters 1630 and 1640 each can freely rotate horizontally when powered wheelchair 1000 moves.

Although suspension systems, powered wheelchairs comprising independent suspension systems, and/or methods for assembling such powered wheelchairs have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any components of the suspension systems and/or the powered wheelchairs, as well as the steps to assemble the powered wheelchairs with independent suspension systems, may be modified, and that the foregoing discussion of certain of these embodiments does not necessarily represent a complete description of all possible embodiments. For instance, the settings of the air suspension subsystems, such as the coil springs or the air bags used and the air pressure, in various embodiments can differ for different body weights of users.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A suspension system for a powered wheelchair, the suspension system comprising:
- an arm; and
- an air suspension subsystem comprising:
  - a coil spring; and
  - an air bag surrounded by the coil spring,
- wherein:
  - the arm is configured to:
    - (a) couple a drive axle to a rod of a frame of the powered wheelchair; and
    - (b) move the drive axle relative to the frame by swiveling around the rod of the frame;
  - the rod of the frame extends parallel to a central longitudinal axis of the powered wheelchair;
  - a first end of the drive axle is coupled to a wheel of the powered wheelchair;
  - the frame is closer to a second end of the drive axel than the first end;
  - the first end of the drive axle is opposite the second end of the drive axle;
  - a first end of the air suspension subsystem is coupled to the frame;
  - a second end of the air suspension subsystem is coupled to the arm; and
  - the second end of the air suspension subsystem is opposite the first end of the air suspension subsystem.

2. The suspension system of claim 1, wherein:
- the first and second ends of the air suspension subsystem are at distal ends of a helical axis of the coil spring; and the helical axis is non-parallel to the central longitudinal axis.

3. The suspension system of claim 1, wherein the powered wheelchair further comprises a controller configured for a user to control an air pressure of the air bag while the user is sitting in the powered wheelchair.

4. The suspension system of claim 1 further comprising a dampener, wherein:

a first end of the dampener is coupled to the frame of the powered wheelchair;

a second end of the dampener is coupled to a distal end of the arm away from the rod; and the second end of the dampener is opposite the first end of the dampener.

5. The suspension system of claim 4, wherein an angle between the dampener and the arm is adjustable based on an adjustable location where the first end of the dampener is coupled to the frame of the powered wheelchair.

6. The suspension system of claim 1, wherein the air bag is centered within the coil spring along a helical axis of the coil spring.

7. A powered wheelchair comprising:

a seat;

a frame configured to support the seat;

a first wheel assembly comprising:

a first wheel;

a first drive axle coupled to the first wheel; and a first suspension system configured to movably couple the first drive axle, at an end of the first drive axle away from the first wheel, to the frame; and a second wheel assembly comprising:

a second wheel;

a second drive axle coupled to the second wheel; and a second suspension system configured to movably couple the second drive axle, at an end of the second drive axle away from the second wheel, to the frame, wherein:

the first wheel assembly and the second wheel assembly are positioned symmetrically about a central longitudinal axis of the powered wheelchair;

at least one of the first suspension system or the second suspension system further comprises:

a respective arm; and a respective air suspension subsystem comprising:

a respective coil spring; and a respective air bag surrounded by the respective coil spring;

a respective first end of the respective air suspension subsystem is coupled to the frame;

a respective second end of the respective air suspension subsystem is coupled to the respective arm; and the respective second end of the respective air suspension subsystem is opposite the respective first end of the respective air suspension subsystem.

8. The powered wheelchair of claim 7, wherein:

the frame of the powered wheelchair further comprises a rod extending parallel to the central longitudinal axis of the powered wheelchair;

the respective arm is coupled to the rod;

the respective arm is configured to move a respective drive axle relative to the frame by swiveling around the rod;

the respective first and second ends of the respective air suspension subsystem are at respective distal ends of a respective helical axis of the respective coil spring; and the respective helical axis is non-parallel to the central longitudinal axis.

9. The powered wheelchair of claim 7 further comprising a controller configured for a user to control a respective air pressure of the respective air bag while the user is sitting in the seat of the powered wheelchair.

10. The powered wheelchair of claim 7, wherein:

at least one of the first suspension system or the second suspension system further comprises a respective dampener;

a first end of the respective dampener is coupled to the frame of the powered wheelchair;

a second end of the respective dampener is coupled to the at least one of the first suspension system or the second suspension system; and the second end of the respective dampener is opposite the first end of the respective dampener.

11. The powered wheelchair of claim 10, wherein:

a respective angle between the respective dampener and a vertical axis of the powered wheelchair is adjustable based on an adjustable location where the first end of the respective dampener is coupled to the frame of the powered wheelchair; and the vertical axis is perpendicular to the central longitudinal axis.

12. The powered wheelchair of claim 7 further comprising front casters, wherein:

each caster of the front casters is coupled to the frame of the powered wheelchair by a respective torsion spring hinge configured to allow the each caster to move upward vertically when the each caster hits an obstacle.

13. The powered wheelchair of claim 7 further comprising rear casters configured to prevent the powered wheelchair from tipping backwards.

14. A method for assembly a powered wheelchair comprising:

movably coupling a first drive axle of a first wheel assembly to a frame of the powered wheelchair by a first suspension system of the first wheel assembly; and movably coupling a second drive axle of a second wheel assembly to the frame of the powered wheelchair by a second suspension system of the second wheel assembly, wherein:

the first drive axle is coupled to a first wheel of the first wheel assembly, at an end of the first drive axle away from the frame;

the second drive axle is coupled to a second wheel of the second wheel assembly, at an end of the second drive axle away from the frame;

the first wheel assembly and the second wheel assembly are positioned symmetrically about a central longitudinal axis of the powered wheelchair;

at least one of the first suspension system of the first wheel assembly and the second suspension system of the second wheel assembly further comprises:

a respective arm; and a respective air suspension subsystem comprising:

a respective coil spring; and a respective air bag surrounded by the respective coil spring;

a respective first end of the respective air suspension subsystem is coupled to the frame of the powered wheelchair;

a respective second end of the respective air suspension subsystem is coupled to the respective arm; and the respective second end of the respective air suspension subsystem is opposite the respective first end of the respective air suspension subsystem.

15. The method of claim 14, wherein:

the frame of the powered wheelchair further comprises a rod extending parallel to the central longitudinal axis of the powered wheelchair;

the respective arm is coupled to the rod;

the respective arm is configured to move a respective drive axle relative to the frame by swiveling around the rod;

the respective first and second ends of the respective air suspension subsystem are at respective distal ends of a respective helical axis of the respective coil spring; and the respective helical axis is non-parallel to the central longitudinal axis.

16. The method of claim 14, wherein the powered wheelchair further comprises a controller configured for a user to control a respective air pressure of the respective air bag, while the user is sitting in the powered wheelchair.

17. The method of claim 14 further comprising:

coupling a second end of a respective dampener to at least one of the first suspension system or the second suspension system; and coupling a first end of the respective dampener to the frame of the powered wheelchair, wherein:

the second end of the respective dampener is opposite the first end of the respective dampener.

18. The method of claim 17 further comprising:

coupling the first end of the respective dampener to an adjustable location of the frame of the powered wheelchair so that a respective angle between the respective dampener and a vertical axis of the powered wheelchair is adjustable.

19. The method of claim 14 further comprising:

coupling each caster of front casters of the powered wheelchair to the frame of the powered wheelchair by a respective torsion spring hinge, wherein:

the respective torsion spring hinge is configured to allow the each caster to move upward vertically when the each caster hits an obstacle.

20. The method of claim 14 further comprising:

coupling rear casters to the frame of the powered wheelchair, wherein:

the rear casters are configured to prevent the powered wheelchair from tipping backwards.

* * * * *